US007303305B2

(12) United States Patent
Kennedy

(10) Patent No.: US 7,303,305 B2
(45) Date of Patent: Dec. 4, 2007

(54) ACOUSTIC LIGHT EMITTING MODULE

(75) Inventor: Sheila Kennedy, Boston, MA (US)

(73) Assignee: Kennedy & Violich Architecture, Ltd., Boston, MA (US)

( * ) Notice: Subject to any disclaimer, the term of this patent is extended or adjusted under 35 U.S.C. 154(b) by 1022 days.

(21) Appl. No.: 10/635,112

(22) Filed: Aug. 6, 2003

(65) Prior Publication Data

US 2004/0070967 A1 Apr. 15, 2004

Related U.S. Application Data

(60) Provisional application No. 60/401,356, filed on Aug. 6, 2002.

(51) Int. Cl.
*F21S 8/00* (2006.01)

(52) U.S. Cl. ..... 362/147; 362/148; 362/150; 362/227

(58) Field of Classification Search ..... None
See application file for complete search history.

(56) References Cited

U.S. PATENT DOCUMENTS

| | | | | | |
|---|---|---|---|---|---|
| 2,935,151 | A * | 5/1960 | Watters et al. | ..... | 52/145 |
| 4,330,691 | A | 5/1982 | Gordon | ..... | 179/146 |
| 4,577,264 | A | 3/1986 | Plumly | ..... | 362/252 |
| 4,829,728 | A * | 5/1989 | Castelli | ..... | 52/145 |
| 4,862,334 | A | 8/1989 | Ivey et al. | ..... | 362/149 |
| 4,923,032 | A | 5/1990 | Nuernberger | ..... | 181/150 |
| 5,183,323 | A | 2/1993 | Daniel | ..... | 362/32 |
| 5,301,090 | A | 4/1994 | Hed | ..... | 362/32 |
| 5,457,557 | A * | 10/1995 | Zarem et al. | ..... | 398/116 |
| 5,782,551 | A * | 7/1998 | Capaul | ..... | 362/148 |
| 5,820,247 | A | 10/1998 | Schuler | ..... | 362/96 |
| 6,016,038 | A | 1/2000 | Muller et al. | ..... | 315/291 |
| 6,211,626 | B1 | 4/2001 | Lys et al. | ..... | 315/291 |
| 6,315,428 | B1 | 11/2001 | Chiang | ..... | 362/150 |
| 6,371,637 | B1 | 4/2002 | Atchinson et al. | ..... | 362/555 |
| 6,481,173 | B1 | 11/2002 | Roy et al. | ..... | 52/506.06 |
| 6,540,373 | B2 * | 4/2003 | Bailey | ..... | 362/150 |
| 6,764,196 | B2 * | 7/2004 | Bailey | ..... | 362/147 |
| 2001/0030868 | A1 | 10/2001 | McKinley | ..... | 362/355 |
| 2007/0000201 | A1 * | 1/2007 | Kennedy et al. | ..... | 52/506.06 |

* cited by examiner

*Primary Examiner*—Sharon E. Payne
*Assistant Examiner*—Kristen A Manskar
(74) *Attorney, Agent, or Firm*—Weingarten, Schurgin, Gagnebin & Lebovici LLP

(57) ABSTRACT

A ceiling tile system comprises modular acoustic light-emitting modules which can be of a standard size to be fitted into a hung ceiling or other ceiling system in conjunction with similar acoustic light-emitting modules or conventional ceiling tiles. Each acoustic light-emitting module includes a backing panel, a cover, and a rigid spacing member extending between the backing panel and the cover, with solid state light-emitting elements such as light-emitting diodes (LEDs) arrayed within each module. The cover may be made of fabric including metallic threads to enhance the diffusion of light. In one embodiment, two arrays of LEDs are provided on respective modules. The arrays may be driven independently or together. The LEDs provide shades of white light or colored light, as desired. The cover and lighting elements may be readily removable from the backing panel for ease of maintenance.

40 Claims, 9 Drawing Sheets

ACOUSTIC LIGHT EMITTING MODULE

CROSS REFERENCE TO RELATED APPLICATIONS

This application claims priority under 35 U.S.C. §119(e) of U.S. Provisional Patent Application No. 60/401,356 filed Aug. 6, 2002, the disclosure of which is hereby incorporated by reference herein.

STATEMENT REGARDING FEDERALLY SPONSORED RESEARCH OR DEVELOPMENT

Not Applicable

BACKGROUND OF THE INVENTION

The invention relates to the field of acoustic tile systems and integral lighting elements.

Acoustic improvements are needed in most office, commercial and institutional environments. Sound absorbing sheet products, wall coverings or acoustic tiles are specified and applied in almost every contemporary building to address this need. Such existing systems accommodate all building life safety codes, are easy to install, inexpensive and ubiquitous. However, existing acoustic tiles have performance limitations in the face of changing work and lifestyle practices. The miniaturization of mobile communication and information tools and the advent of internet and wireless distribution networks have placed a premium on spatial flexibility for individuals and small and large groups. As mobility increases in residential, public and commercial settings, the overall architectural flexibility of space is increasingly important, and the attendant problem of providing acoustic privacy and a sense of individual place also increases.

Currently, acoustic controls are provided for example in the form of suspended ceiling tiles, which are combined with separate lay-in fluorescent light fixtures for lighting needs. However, this standard arrangement may be less than desirable from the perspectives of functional energy consumption, light control, light personalization and aesthetic appearance. The ceiling is an important architectural surface, yet its functional potential to both absorb sound and to distribute light in an energy-efficient manner which allows for the control of individual ceiling areas with an aesthetic design is currently ignored.

Thus, there is a need for an improved acoustic tile system that can be easily adapted for example to existing ceiling systems as well as building codes and construction conventions. It is advantageous for such an improved ceiling system to incorporate lighting and acoustic needs while providing for flexible aesthetic and functional alternatives to standard acoustic tile systems.

BRIEF SUMMARY OF THE INVENTION

In accordance with the present invention, an acoustic light emitting tile system is disclosed which provides improvements in both lighting and acoustical performance with greater aesthetic appeal than traditional systems.

The tile system comprises modules which can be incorporated into a conventional, modular hung ceiling or similar ceiling system. The tile system can be readily implemented within existing construction practices and can meet construction and architectural standards and building codes, including such codes for fire-rated assemblies where the wall cladding and structural connections contribute to the fire-rated structure of the building. The system also accommodates interruptions in the ceiling such as the penetration of sprinkler heads, structural elements, and other penetrations, and provides access to the plenum for maintenance.

Each module includes a backing panel, a light-diffusing, acoustically non-reflective cover, and light-emitting elements disposed between the backing panel and cover. The backing panel can be curved or planar in form, and may be a sound absorbing ceiling tile or an acoustic backing panel. The cover may be a woven fabric, a non-woven material, or a translucent rigid material which is micro-perforated or similarly treated to provide for sound absorption. A cylindrical sleeve or similar rigid spacing member may be used to separate the cover from the backing panel, creating an aesthetically interesting shape with the functional ability to scatter sound by creating non parallel relationships between floor and ceiling. These relationships may be customized in the manufacturing process by varying the dimension between the backing panel and the rigid spacer member, creating different sculptural and sound scattering topographies in the ceiling plane. A void between the backing panel and the rigid spacer member may be filled with lightweight sound absorbent foam, pellets or other acoustic materials.

The modules may be used with other like modules for an independent ambient lighting system in which solid state lighting elements such as light-emitting diodes (LEDs), high brightness LEDs (HBLEDs), organic LEDs (OLEDs), or electroluminescent (EL) elements replace conventional fluorescent lighting. Alternatively, the modules may be used in conjunction with traditional and/or compact fluorescent light sources. The modules can be adjacent to form a continuous ceiling surface, or they may be spaced apart and intermixed with other ceiling components such as traditional acoustic ceiling tiles and other existing standard light fixtures. Additionally, the modules can be used on vertical wall surfaces or other surfaces where both lighting and acoustic functionality is desired.

The solid state lighting elements can be arrayed in one or more assemblies within each module, such as along the backing panel or the spacer member or integrated into the cover. In one embodiment, two arrays of LEDs are provided on respective modules. The arrays may be driven independently or together. The LEDs provide shades of white light or colored light, as desired.

The system can provide a dynamic sculptural ceiling surface that integrates acoustic treatment with energy-efficient, analog and digitally controllable, ambient lighting employing color-changing solid state lighting elements. The integration of acoustics and lighting permits a more aesthetically pleasing, consistent and highly adaptable ceiling surface which is uninterrupted by the configuration and glare of individual lighting fixtures.

In particular, the solid-state lighting elements can be hardwired and controlled with conventional switches, or they can be controlled with digital electronics using either hardwired or wireless methods. Digital electronic controls used in conjunction with the system result in greater individual control of single modules or of an area of modules in an energy efficient manner. Individuals or groups can select the intensity and/or color of light for a particular ceiling area according to need and preference. This control can happen in real time or it can be set to automatically change over a period of time, in conjunction with a microprocessor or other electronic control device.

Additionally, the disclosed system provides the ability to "undress" or strip back an outer part of a ceiling covering surface for maintenance rather than requiring the displacing or replacing of a complete rigid tile as is the current convention. This feature has the benefit of enabling maintenance and access to the lighting elements without interfering with the fire-rated wall or ceiling panel assembly.

Other aspects, features, and advantages of the present invention will be apparent from the Detailed Description of the Invention that follows.

BRIEF DESCRIPTION OF THE SEVERAL VIEWS OF THE DRAWING

The invention will be more fully understood by reference to the following Detailed Description of the Invention in conjunction with the Drawing, of which.

DETAILED DESCRIPTION OF THE INVENTION

Figure 1:
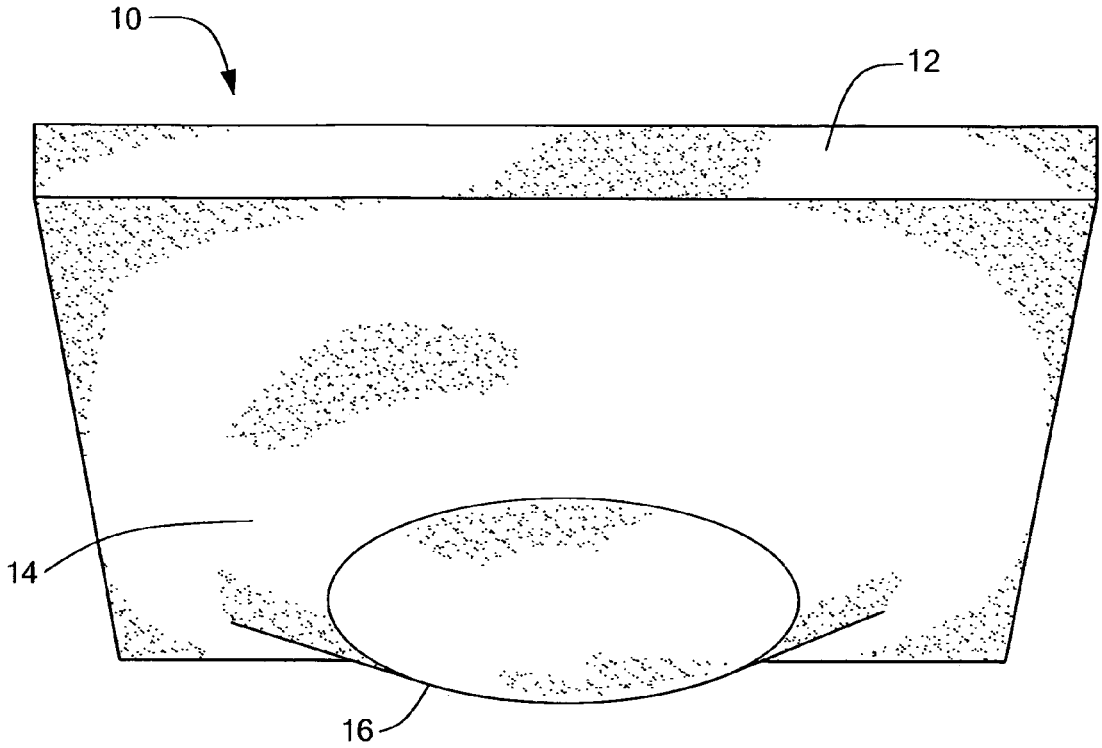
FIG. 1 is a perspective view of a light-emitting acoustic module in accordance with the present invention.

FIG. 1 shows a perspective view of a light-emitting acoustic module 10. The module 10 includes a backing panel 12 with a light-diffusing cover 14 extending across one surface. The cover 14 covers a cylindrical sleeve 16 extending from one surface of the backing panel 12 to provide the module 10 with a truncated conical shape. In one embodiment, the cover 14 is made of a woven cloth such as polyester with metallic light reflective fibers. The woven cloth may be stretchable and installed in a stretched condition, or it may be draped. Other embodiments may deploy translucent or honeycomb structured materials or non woven materials, or rigid coverings with micro-perforations to permit sound entry. Such rigid coverings may be enhanced by the integration of luminous phosphor pigments. When excited by the LEDs or fluorescent sources, such a cover gives off light to provide a practical safety function in the event of a power loss.

The cover 14 is attached to the backing panel in one of two manners. A stretchable elastic sleeve (not shown) may be placed along the edges of the cover 14 and slipped over the backing panel 12, additionally securing the cylindrical sleeve 16 and internal lighting elements (not shown in FIG. 1). When the module 10 is displaced for installation or to permit access to the plenum, its edges are exposed and the elastic sleeve may be readily removed, providing access to the lighting elements. Alternatively, in the case where direct access is desirable from below (without engagement of the plenum) a hook-and-pile, snap, or other mechanical fastener may be used to allow the cover 14 to be readily removed without displacing the backing panel 12.

Figure 2:
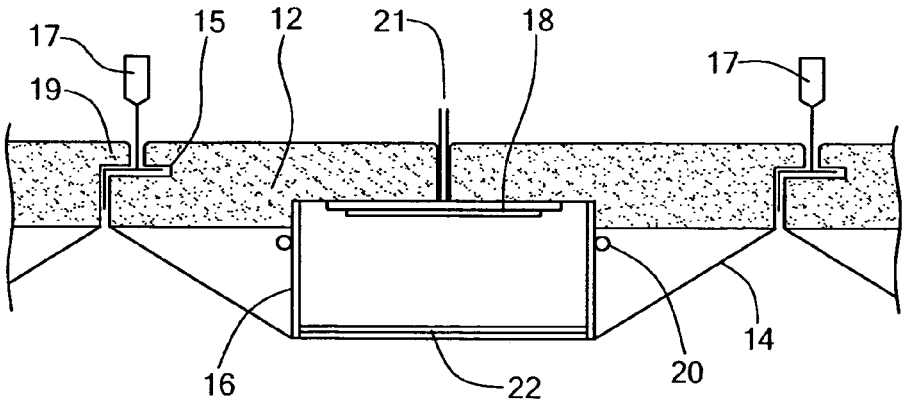
FIG. 2 is a section view of the light-emitting acoustic module of FIG. 1.

Referring to FIG. 2, the module 10 is shown in schematic edge view as part of a hung ceiling of like modules. The edges of the backing panel 12 are formed to provide for overlap between adjacent modules. Also, a narrow slot 15 is formed at the edges to receive one flange of a T-shaped hanger 17. The other flange of the hanger 17 supports the extending edge portion 19 of an adjacent module. Although in the illustrated embodiment the T-shaped hanger 17 is of the type found in conventional hung ceiling systems, other types of support elements may be employed in alternative embodiments. In an application in which the module 10 is attached to a wall (in a movie theater for example), separate mechanical fasteners may be used to attach the modules 10 to a system of T-shaped support elements.

The sleeve 16 is made of clear acrylic, perforated metal or other rigid material and is disposed in a slight depression in the backing panel 12. The sleeve 16 is attached to the backing panel 12 with a flexible pop-in lip, screw-in sleeve connection or other mechanical fastener. A translucent diffuser film 22 is disposed over the outer end of the sleeve 16 and supported by the cover 14. The diffuser film 22 may be a lenticular surface used to help spread and direct the light, such as a lenticular pattern etched on a polycarbonate disk.

An LED assembly 18 includes a ring of LEDs contained on a rigid circuit board which is disposed on the backing panel 12), which may be a sound-absorbing standard ceiling module panel concealed by the cover 14 or an acoustic backing board. A second LED assembly 20 includes a flexible strip of LEDs disposed around the outer perimeter of the sleeve 16. Examples of components that can be used in LED assemblies 18 and 20 are described below. The LED assemblies 18 and 20 receive electrical power via wires 21 extending though an opening in the backing panel 12. Other embodiments may employ remote photo-voltaic power sources or battery packs, which are efficient for solid state light sources such as LEDs. Various other configurations of LEDs can be provided to achieve particular lighting, signaling and wayfinding effects.

LED-based lighting elements such as LED assemblies 18 and 20 (and including variants such as OLEDs and HBLEDs) provide a number of benefits in comparison to conventional fluorescent or other lighting fixtures. They require lower operating voltages. The LEDs are long lasting and can typically be employed for a period of 10 years at full intensity. The LEDs are also efficient and can provide significant energy savings. In addition, the LEDs can easily be electronically controlled with wireless or hardwired circuits, and can be linked to computerized facility management systems, timers, motion/photo sensors, microprocessors and the like. Moreover, the LEDs can be programmed to provide light in various tile sequence color mixes or levels of intensity.

Under daylight conditions, the cover 14 is effective to distribute daylight deeper into the ceiling space from perimeter windows or other sources of daylight. The cover 14 also diffuses the LED light to produce an even wash of light across the surface of the backing panel 12. Sound is absorbed through the cover 14 and by the backing panel 12. The interior air cavity or space between the backing panel 12 and the cover 14 also attenuates and traps sound. Speakers and other audio system components may be integrated into the air cavity where they are concealed by the cover 14. The conical form of the cover 14 also serves to diffuse sound and to alter the typical parallel spacing between floor and ceiling.

Figure 3:
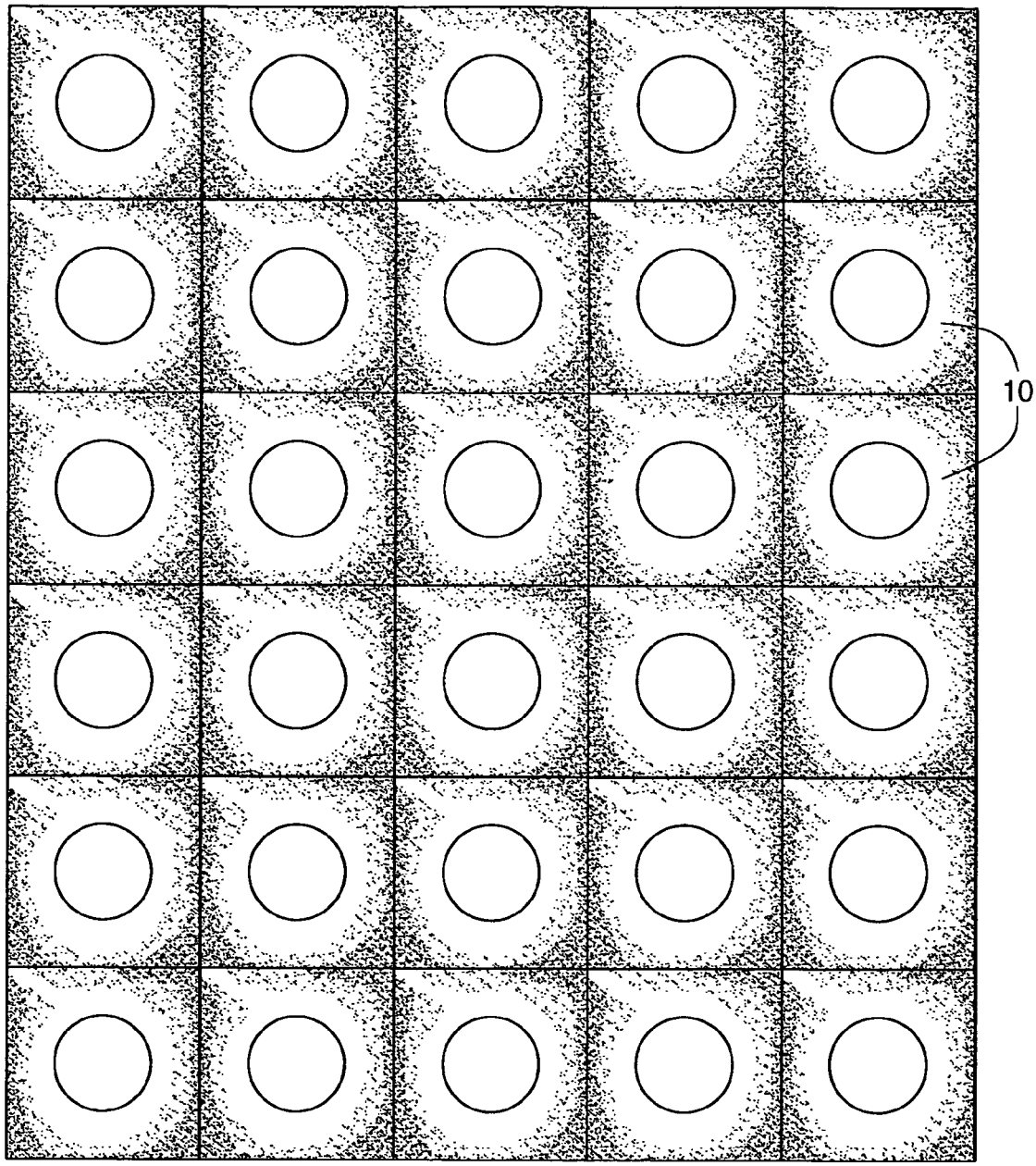
FIG. 3 is a diagram of a ceiling surface including numerous adjacent modules of the type shown in FIG. 1.
Figure 4:
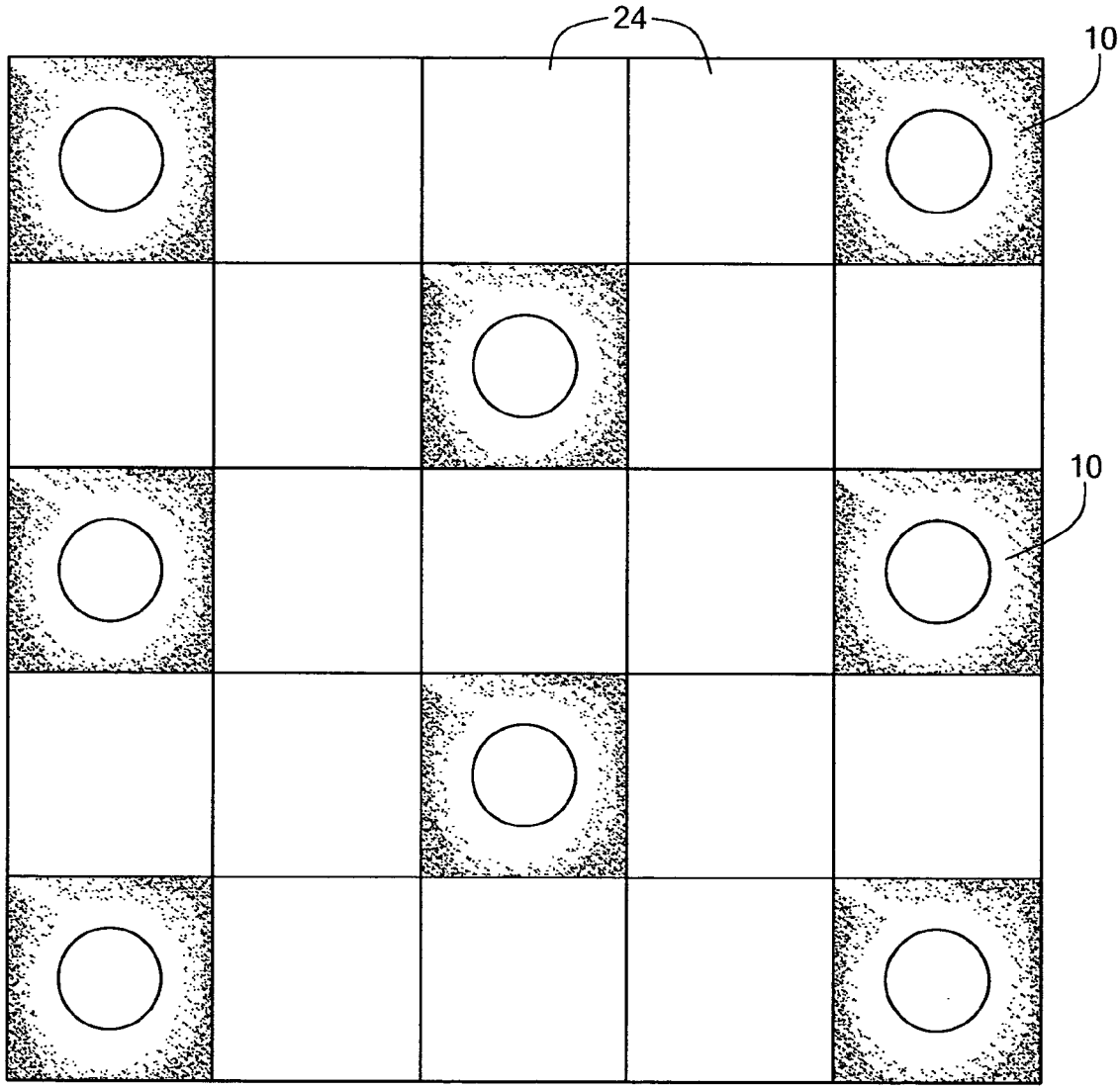
FIG. 4 is a diagram of a ceiling surface including spaced-apart modules of the type shown in FIG. 1.

FIG. 3 shows a ceiling surface including a number of modules 10 arranged adjacent to each other. FIG. 4 shows an alternative ceiling surface in which the modules 10 are spaced apart, for example by conventional acoustic ceiling tiles 24. In each case, the modules 10 are shown in a state in which only the inner LED assembly 18 is lighted. As can be appreciated, the conical form of the module 10 with its light diffusing cover 14 and integral solid state light assemblies 18 and 20 produces a ceiling plane with unique functional and aesthetic effects. The degree of blended light and color from the two LED assemblies 18 and 20 creates different perceptions of the physical shape of the modules 10. The ceiling plane can appear to be rounded, flattened and variously modulated by the play of receding color light within the volume of each module 10. Unlike conventional hung ceilings, the modules 10 create ceiling lighting which can be adjusted by users to create variable and dynamic luminous and sculptural effects.

Figure 5:
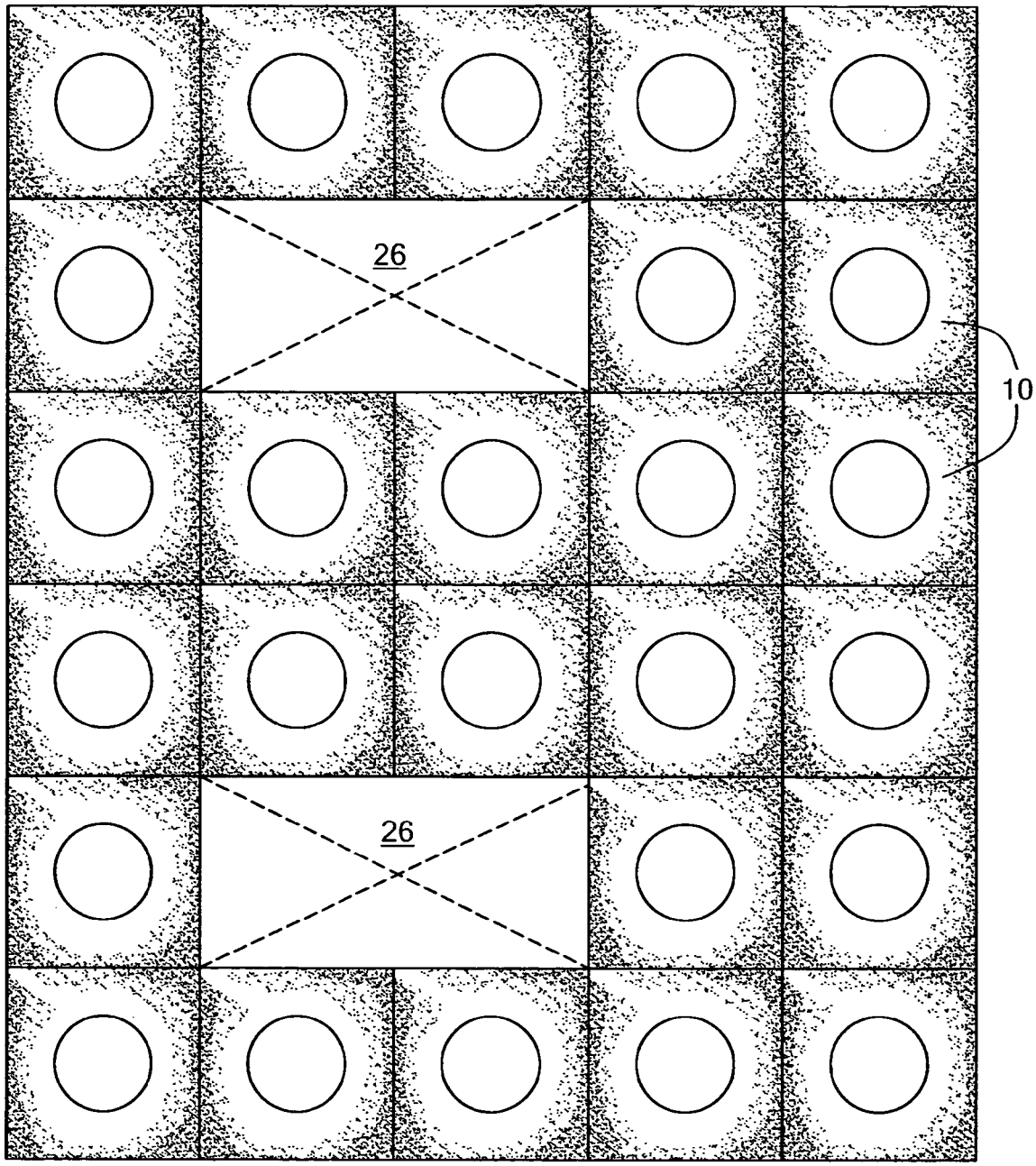
FIG. 5 is a diagram of a ceiling surface including modules of the type shown in FIG. 1 in conjunction with standard fluorescent light fixtures.

FIG. 5 shows a ceiling surface in which the modules 10 are interspersed with standard fluorescent lighting fixtures 26.

Figure 6:
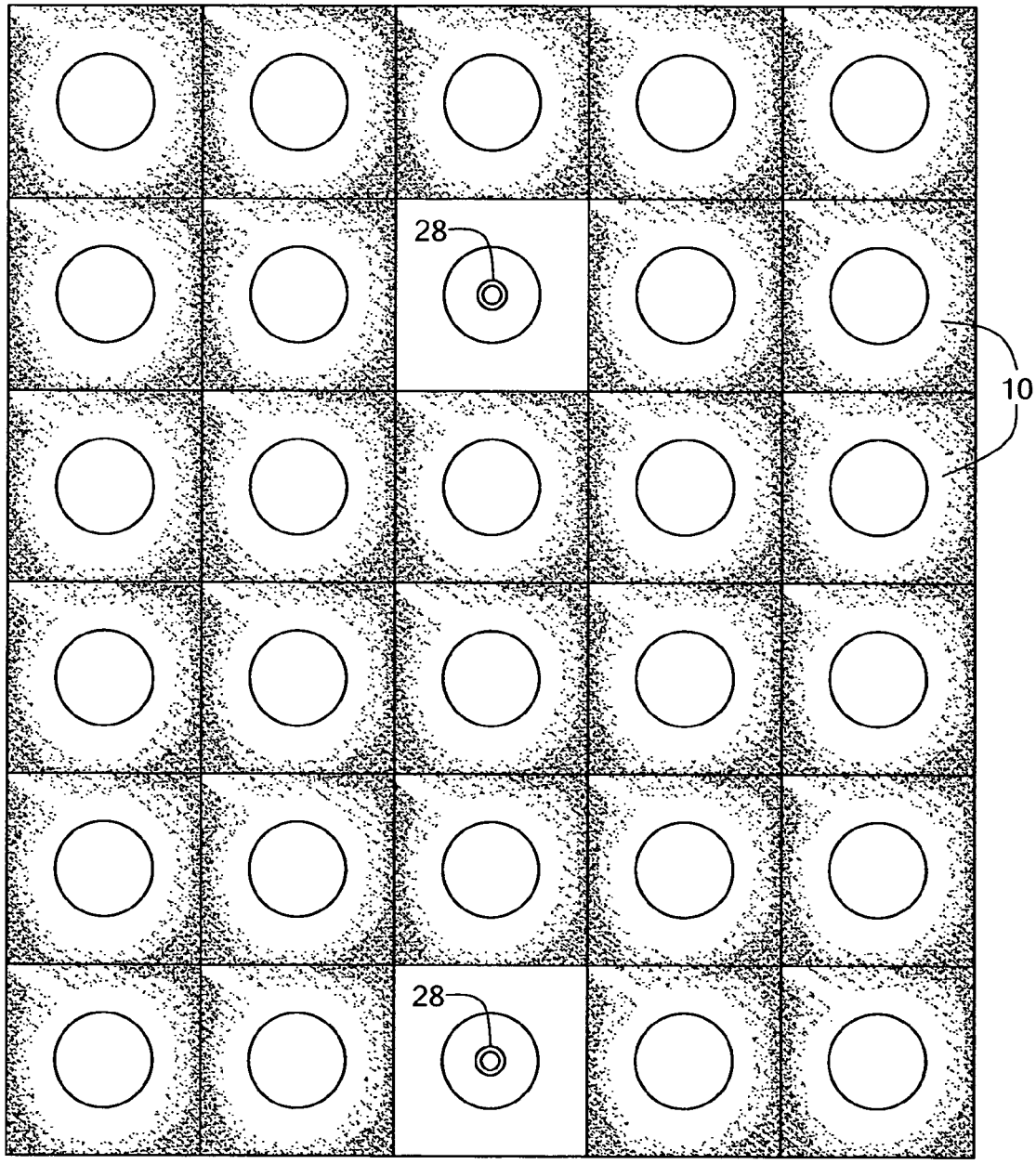
FIG. 6 is a diagram of a ceiling surface including modules similar to the module of FIG. 1 in conjunction with fire system sprinkler heads.
Figure 7:
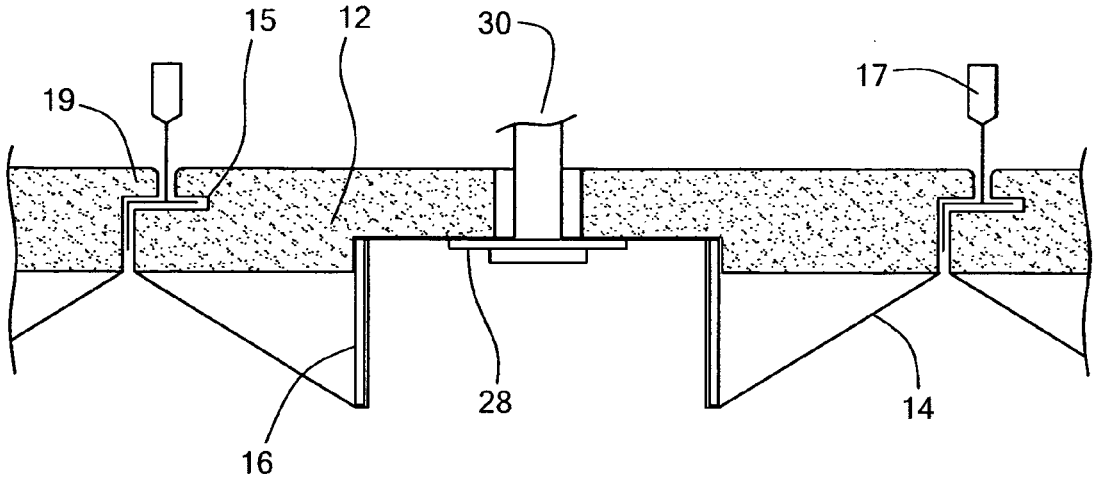
FIG. 7 is a section view of a module for use with sprinkler heads as in FIG. 6.

FIGS. 6 and 7 illustrate the use of the modules in conjunction with fire system sprinkler heads. A sprinkler head with a conventional fusible link and cover plate 28 may be located flush to the backing panel 12 within the sleeve 16 in place of the LED assembly 18. In this embodiment, the diffuser 22 is also absent, and the cover 14 is secured around the opening established by LED assembly 20 using a rigid edge lip of acrylic or metal. An opening is also formed in the backing panel 12 to permit passage of the pipe 30. Alternatively (not shown in FIG. 7), the sprinkler head may be extended through the void within the sleeve 16 to protrude beyond the end of the sleeve 16.

Figure 8:
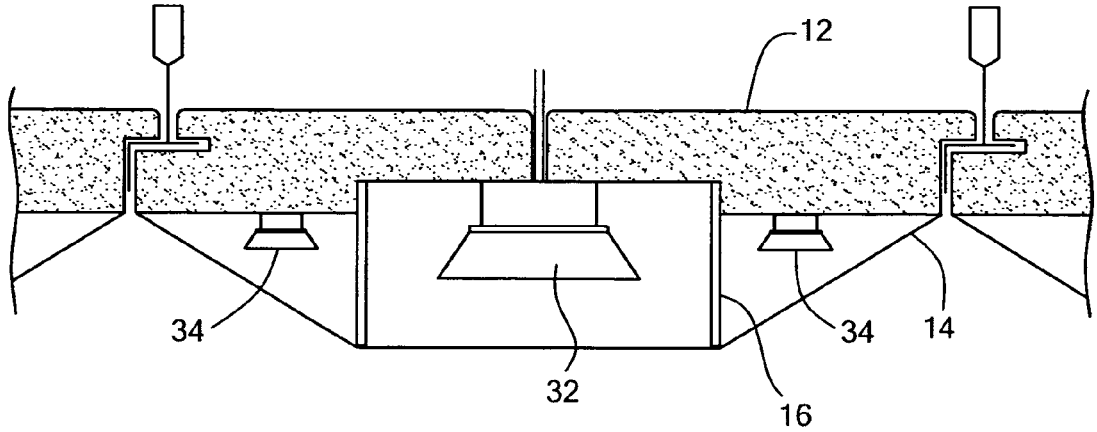
FIGS. 8-10 are section views of modules similar to the module of FIG. 1 with alternative features.

FIG. 8 shows a module including speakers 32 and 34. The speaker 32 is disposed within the sleeve 16, while the speakers 34 are disposed in the cavity lying between the cover 14 and the backing panel 12 outside the sleeve 16. Alternative embodiments may employ only the central speaker 32 or only the outer speaker(s) 34.

Figure 9:
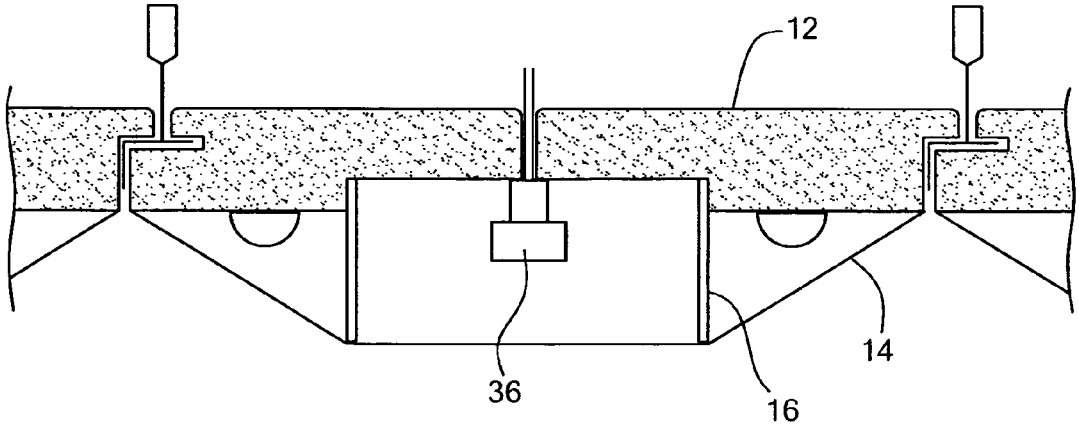
Figure 10:
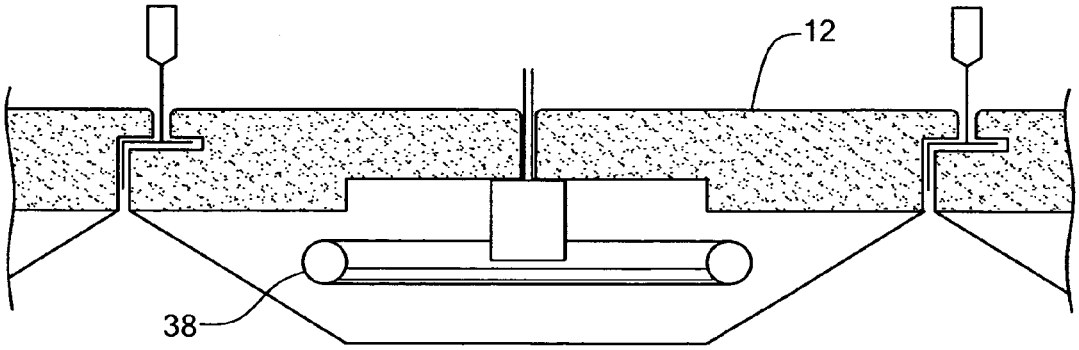

FIG. 9 shows a module including a wireless/infrared (IR) router or network access point 36. FIG. 10 shows a module incorporating a circular fluorescent lamp 38.

Figure 11:
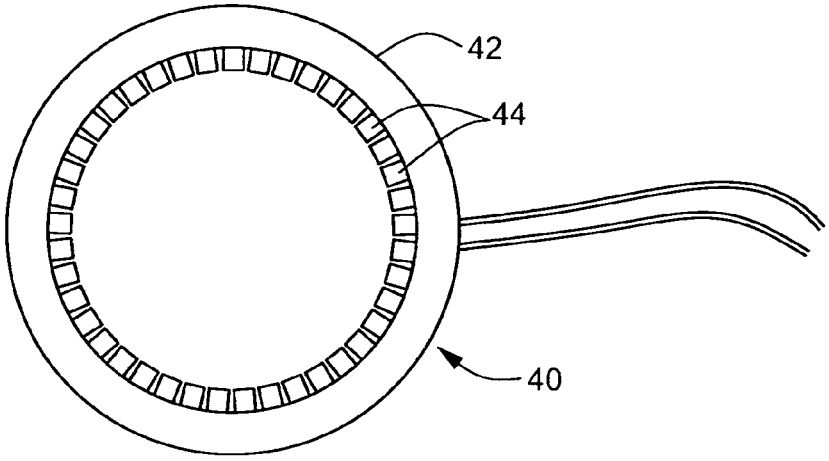
FIGS. 11-16 are diagrams of LED assemblies that can be used in a light-emitting acoustic module in accordance with the present invention.
Figure 12:
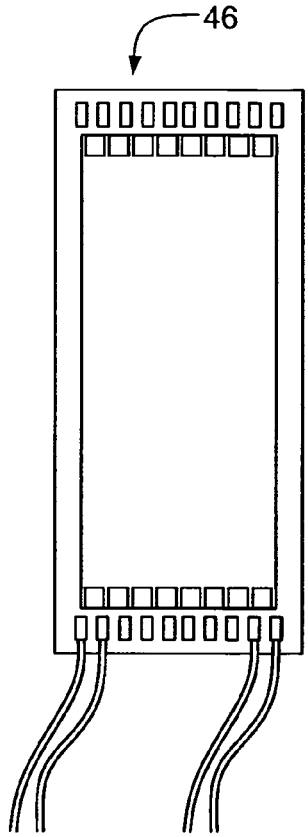
Figure 13:
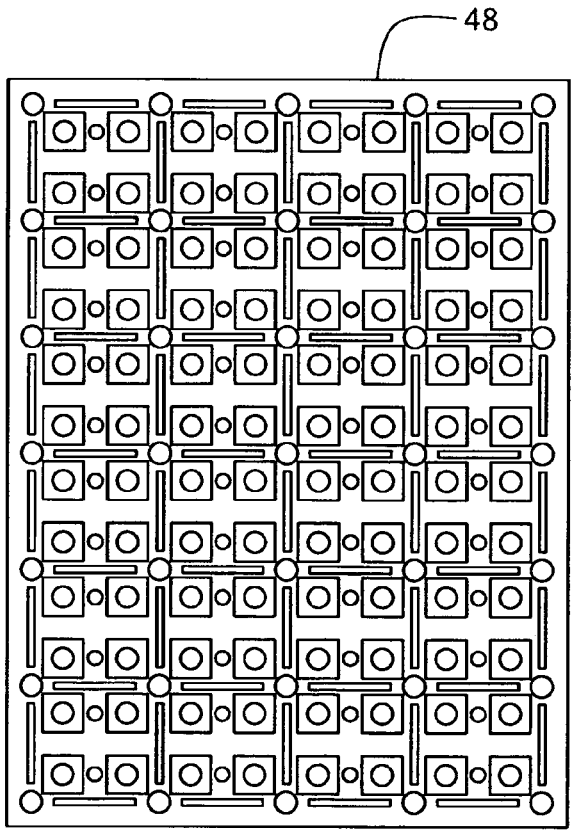
Figure 14:
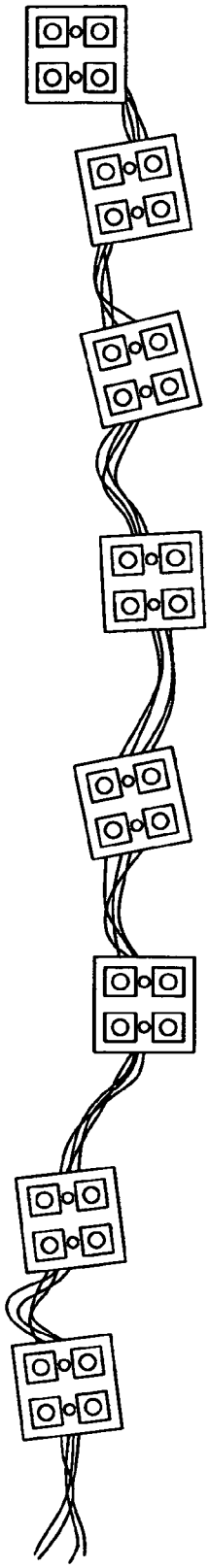
Figure 15:
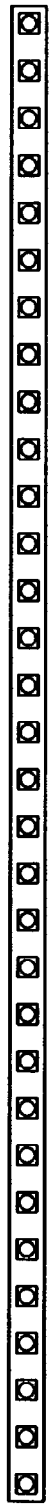
Figure 16:
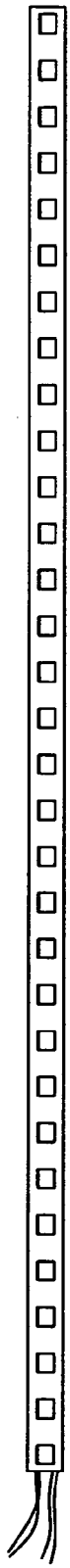

FIGS. 11-16 show various configurations of LED assemblies that may be employed. FIG. 11 shows an assembly 40 employing a circular PC board 42 with LEDs 44 arranged along the inner edge. The assembly 40 can serve as the inner LED assembly 18 of the module 10 (see FIG. 2). FIG. 12 shows a rectangular assembly 46. FIG. 13 shows a grid formed on a flexible circuit 48. Such flexible circuits can be employed in a variety of ways. In the module 10 described above, for example, one or more circuits 48 can be wrapped around the outer part of the sleeve 16. FIG. 14 shows an assembly in which blocks 50 each having a 2×2 array of LEDs are interconnected by wire in a chain-like fashion. FIG. 15 shows a strip 52 and FIG. 16 shows a strip 54 of LEDs on a narrow flexible circuit board. The strip 54 can serve as the outer LED assembly 20 of the module 10 (see FIG. 2).

The modules 10 can be manufactured as integrated units containing the LED assemblies 18 and 20 along with the cover 14 and other components, providing for ready installation and replaceability. Alternatively, the LED assemblies 18 and 20 can be provided as separate elements which are installed on site on the modules 10.

Although in the illustrated embodiment, the backing panel 12 is planar, it may be advantageous to employ other shapes in alternative embodiments, including for example a curved shape like the shape of a shallow bowl. Additionally, the modules may be employed either singly or in clusters as opposed to an array as illustrated in FIGS. 3-5 for example. Such configurations would generally employ different support structures than the grid of T-shaped hangers 17 employed in a typical hung ceiling system. For example, a module may be attached to support elements via mounting features on the back of the module. In alternative arrangements employing clusters of modules, modules may be disposed at different heights and at different angles to permit acoustic tuning for example. Rather than being placed edge-to-edge, it may be desirable that the modules overlap in such embodiments. Additionally, it may be desirable to employ non-rectangular backing panels, such as round or oval.

It will be apparent to those skilled in the art that modifications to and variations of the disclosed methods and apparatus are possible without departing from the inventive concepts disclosed herein, and therefore the invention should not be viewed as limited except to the full scope and spirit of the appended claims.

What is claimed is:

1. A light-emitting acoustic module, comprising:

a backing panel attachable to a support, the backing panel having a periphery;

a light-diffusing, acoustically non-reflective cover attached to and around the periphery of the backing panel, at least a portion of the cover being spaced apart from the backing panel to define a cavity between the backing panel and the cover, the cover forming a ceiling surface; and a plurality of light-emitting elements disposed in the cavity between the backing panel and the cover, the light-emitting elements being operative to produce light diffusable through the cover.

2. A light-emitting acoustic module according to claim 1, wherein the cover is fabric.

3. A light-emitting acoustic module according to claim 2, wherein the fabric cover is draped or stretched over the backing panel.

4. A light-emitting acoustic module according to claim 1, wherein the cover is made of a non-rigid material, and further comprising a rigid spacing member disposed between the backing panel and the cover maintaining separation therebetween.

5. A light-emitting acoustic module according to claim 4, wherein the spacing member is a centrally disposed cylindrical sleeve.

6. A light-emitting acoustic module according to claim 4, wherein the light-emitting elements are attached to the spacing member.

7. A light-emitting acoustic module according to claim 4, wherein the spacing member has a central opening, and wherein the light-emitting elements are disposed within the central opening of the spacing member.

8. A light-emitting acoustic module according to claim 1, wherein the cavity attenuates and traps sound.

9. A light-emitting acoustic module according to claim 1, further comprising audio loudspeakers disposed in the cavity.

10. A light-emitting acoustic module according to claim 1, further comprising a wireless network access point disposed in the cavity.

11. A light-emitting acoustic module according to claim 1, wherein the cover is a rigid material.

12. A light-emitting acoustic module according to claim 11, wherein the cover includes small perforations to provide for sound entry.

13. A light-emitting acoustic module according to claim 11, wherein the cover includes integrated phosphor pigments so as to be excited by the lighting elements and emit light.

14. A light-emitting acoustic module according to claim 1, wherein the lighting elements are located on the backing panel.

15. A light-emitting acoustic module according to claim 1, wherein the light-emitting elements include at least one array of light-emitting diodes (LEDs).

16. A light-emitting acoustic module according to claim 15, wherein the LEDs include organic LEDs (OLEDs).

17. A light-emitting acoustic module according to claim 15, wherein the LEDs include high brightness LEDs (HBLEDs).

18. A light-emitting acoustic module according to claim 15, wherein at least two arrays of light-emitting diodes are included, a first array being centrally located and a second array being disposed about the first array and spaced apart therefrom.

19. A light-emitting acoustic module according to claim 1, wherein the cover is made of a woven material.

20. A light-emitting acoustic module according to claim 19, wherein the woven material incorporates metallic light-reflective fibers.

21. A light-emitting acoustic module according to claim 1, wherein the backing panel is planar and edge-suspendible so as to be usable in a hung ceiling system.

22. A light-emitting acoustic module according to claim 21, wherein the edges of the backing panel have a stepped configuration for overlapping the edges of adjacent modules when installed in the hung ceiling system.

23. A light-emitting acoustic module according to claim 1, wherein the backing panel includes mounting features disposed on a rear surface thereof for attaching the backing panel to the support.

24. A light-emitting acoustic module according to claim 23, wherein the mounting features are configured to allow for a cluster of multiple similar modules to be mounted in overlapped fashion.

25. A light-emitting acoustic module according to claim 24, wherein the backing panel in each of the modules of the cluster is planar and oval.

26. A light-emitting acoustic module according to claim 1, wherein the backing panel is planar and rectangular.

27. A light-emitting acoustic module according to claim 26, wherein the backing panel is square.

28. A light-emitting acoustic module according to claim 1, wherein the backing panel is planar and oval.

29. A light-emitting acoustic module according to claim 1, wherein the backing panel is planar and round.

30. A light-emitting acoustic module according to claim 1, wherein the light-emitting elements comprise color-changing solid state lighting elements.

31. A light-emitting acoustic module according to claim 30, wherein the color-changing solid state lighting elements comprise stacked red-green-blue (RGB) light-emitting diode (LED) chips.

32. A light-emitting acoustic module according to claim 30, wherein the solid-state lighting elements are controllable via analog electronics.

33. A light-emitting acoustic module according to claim 30, wherein the solid-state lighting elements are controllable via digital electronics.

34. A light-emitting acoustic module according to claim 33, wherein the digital electronics are hardwired to the solid-state lighting elements.

35. A light-emitting acoustic module according to claim 33, wherein the digital electronics are wirelessly coupled to the solid-state lighting elements.

36. A light-emitting acoustic module according to claim 1, wherein the light-emitting elements comprise fluorescent lamps.

37. A light-emitting acoustic module according to claim 1, wherein the backing panel is acoustically absorbent.

38. A light-emitting acoustic module according to claim 1, wherein the backing panel and cover have respective openings for permitting passage of a sprinkler head when the module is installed in a ceiling.

39. A light-emitting acoustic module according to claim 1, wherein the light-emitting elements are disposed on a subassembly that is installable separately from the remainder of the module.

40. A light-emitting acoustic module according to claim 1, wherein the cover is removably attached to the backing panel to permit access to the cavity of the module when installed in a ceiling.

* * * * *